US008319452B1

(12) United States Patent
Hamel et al.

(10) Patent No.: US 8,319,452 B1
(45) Date of Patent: Nov. 27, 2012

(54) DIMMING PROTOCOL DETECTION FOR A LIGHT FIXTURE

(75) Inventors: Yvan Hamel, Laval (CA); Gregory Campbell, Walpole, MA (US)

(73) Assignee: Lumenpulse Lighting, Inc. (CA)

( * ) Notice: Subject to any disclaimer, the term of this patent is extended or adjusted under 35 U.S.C. 154(b) by 0 days.

(21) Appl. No.: 13/344,244

(22) Filed: Jan. 5, 2012

(51) Int. Cl.
*H05B 37/02* (2006.01)

(52) U.S. Cl. ..... 315/291; 315/294; 315/308

(58) Field of Classification Search ..... 315/291, 315/307, 297, 294–295, 308, DIG. 4; 362/85
See application file for complete search history.

(56) References Cited

U.S. PATENT DOCUMENTS

| | | | | |
|---|---|---|---|---|
| 5,751,118 | A | 5/1998 | Mortimer | |
| 6,292,901 | B1 | 9/2001 | Lys et al. | |
| 6,331,756 | B1 | 12/2001 | Belliveau | |
| 7,550,931 | B2 * | 6/2009 | Lys et al. | 315/291 |
| 7,777,427 | B2 | 8/2010 | Stalker, III | |
| 7,961,113 | B2 | 6/2011 | Rabiner et al. | |
| 2009/0066266 | A1 * | 3/2009 | Jungwirth et al. | 315/307 |
| 2011/0140611 | A1 * | 6/2011 | Elek et al. | 315/130 |
| 2011/0148836 | A1 * | 6/2011 | Rumreich | 345/207 |

* cited by examiner

*Primary Examiner* — Jacob Y Choi
*Assistant Examiner* — Henry Luong
(74) *Attorney, Agent, or Firm* — Pierce Atwood LLP; Joseph M. Maraia

(57) ABSTRACT

In some examples, a dimming protocol detection technology includes methods and apparatuses. In other examples, the technology includes a dimmer configured to transmit a dimming input signal. The dimming input signal is in a dimming protocol. The technology further includes a light fixture. The light fixture includes a plurality of lights and a dimming protocol detection module configured to detect the dimming protocol received in the dimming input signal. The dimming protocol is detected from a plurality of dimming protocols. The light fixture further includes a light dimming control module configured to control the plurality of lights based on the detected dimming protocol.

21 Claims, 5 Drawing Sheets

DIMMING PROTOCOL DETECTION FOR A LIGHT FIXTURE

BACKGROUND

Light emitting diode (LED) light fixtures are, generally, configured to operate using a particular dimming protocol (e.g., a 0-10 volt lighting control, digital addressable lighting interface (DALI), etc.) during manufacturing of the light fixture or immediately before shipping from a distribution warehouse. The LED light fixtures are configured to operate using the particular dimming protocol and, generally, can become damaged or destroyed when a different dimming protocol is input into the light fixture's controller. Thus, a need exists in the art for an improved dimming protocol detection processes and apparatuses for a LED light fixture with the features as described herein.

SUMMARY

To address these needs, a dimming protocol detection processes and apparatuses for a LED light fixture (hereinafter referred to as "technology") is used so any LED light fixture can operate with any dimming protocol. The technology includes auto detection apparatuses and/or methods that read dimming input from a dimmer and process the dimming input to differentiate between various dimming protocols in real-time. The technology can then process the dimming input based on the detected dimming protocol to control one or more LED lights (e.g., light emitting diodes (LED), incandescent bulbs, etc.). The technology advantageously enables the automatic detection of dimming protocols and routing of incoming dimming input to the correct dimming hardware and/or software, thereby increasing the reliability of the technology by reducing destroyed and/or damaged light fixtures from incorrect protocols. The technology advantageously decreases the installation time and cost of light fixtures by decreasing the available options for each light installation by removing the requirement to identify and track different dimming protocols in a light system.

One approach to dimming protocol detection is a system that includes a dimmer configured to transmit a dimming input signal. The dimming input signal is in a dimming protocol. The system further includes a light fixture. The light fixture includes a plurality of lights, a dimming protocol detection module configured to detect the dimming protocol received in the dimming input signal, the dimming protocol being detected from a plurality of dimming protocols, and a light dimming control module configured to control the plurality of lights based on the detected dimming protocol.

Another approach to dimming protocol detection is a light fixture that includes a plurality of lights; a dimming protocol detection module configured to detect a dimming protocol received in a dimming input signal; and a light dimming control module configured to control the plurality of lights based on the detected dimming protocol.

Another approach to dimming protocol detection is a method that includes detecting a dimming protocol received in a dimming input signal; and controlling a plurality of lights based on the detected dimming protocol.

Any of the approaches described herein can include one or more of the following examples.

In some examples, the dimming protocol detection module is further configured to select the dimming protocol from a plurality of dimming protocols based on one or more parameters associated with the plurality of dimming protocols.

In other examples, the plurality of dimming protocols includes a 0-10 volt lighting control, digital addressable lighting interface (DALI), digital multiplex (DMX512) lighting interface, a remote device management (RDM) interface, or any combination thereof.

In some examples, the one or more parameters associated with the plurality of dimming protocols include a physical layer parameter, a network layer parameter, or any combination thereof.

In other examples, the physical layer parameter includes a voltage parameter, a current parameter, an isolation parameter, or any combination thereof.

In some examples, the network layer parameter includes a communication protocol parameter, a command format parameter, or any combination thereof.

In other examples, the dimming input signal is received from a dimmer.

In some examples, the dimming protocol detection module is further configured to detect a second dimming protocol received in the dimming input signal; and the light dimming control module is further configured to control the plurality of lights based on the detected second dimming protocol.

In other examples, the light dimming control module is further configured to discontinue control of the plurality of lights based on the detected dimming protocol in real-time with the detection of the second dimming protocol.

In some examples, the light dimming control module includes a plurality of dimming protocol controllers. Each dimming protocol controller of the plurality of dimming protocol controllers is associated with a dimming protocol from the plurality of dimming protocols and configured to convert the dimming input signal from the associated dimming protocol to a control signal for the plurality of lights.

In other examples, the light fixture includes a dimming input module configured to: detect the dimming input signal; and control the plurality of lights based on the detection of the dimming input signal and the detected dimming protocol.

In some examples, the method further includes selecting the dimming protocol from a plurality of dimming protocols based on one or more parameters associated with the plurality of dimming protocols.

In other examples, the plurality of dimming protocols includes a 0-10 volt lighting control, digital addressable lighting interface (DALI), digital multiplex (DMX512) lighting interface, a remote device management (RDM) interface, or any combination thereof.

In some examples, the one or more parameters associated with the plurality of dimming protocols include a physical layer parameter, a network layer parameter, or any combination thereof.

In other example, the method further includes receiving the dimming input signal from a dimmer.

In some examples, the method further includes detecting a second dimming protocol received in the dimming input signal; and controlling the plurality of lights based on the detected second dimming protocol.

In other examples, the method further includes discontinuing control of the plurality of lights based on the detected dimming protocol in real-time with the detection of the second dimming protocol.

In some examples, the method further includes converting the dimming input signal from the associated dimming protocol to a control signal for the plurality of lights.

In other examples, the method further includes detecting the dimming input signal; and controlling the plurality of lights based on the detection of the dimming input signal and the detected dimming protocol.

The dimming protocol detection systems and methods described herein (hereinafter "technology") can provide one or more of the following advantages. An advantage of the technology is the automatic detection of a dimming protocol and control of a light based on the detected dimming protocol, thereby reducing manual configuration during installation of the light while reducing the installation cost for light fixtures and/or light systems. Another advantage of the technology is the automatic detection of a dimming protocol and the control of a light based on the detected dimming protocol, thereby increasing the effective uses of the light fixtures and/or light systems which reduces the maintenance cost by allowing any type of dimmer and/or control system to be utilized for the light fixtures and/or the light systems.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

As a general overview of dimming protocol detection processes and apparatuses for a LED light fixture (hereinafter referred to as "technology"), the technology includes a controller (e.g., auto detection circuitry) for detecting a dimming protocol (e.g., digital multiplex (DMX512) lighting interface, a remote device management (RDM) interface, etc.) in a dimming input signal and controlling one or more lights based on the dimming input and the detected dimming protocol. In other words, the technology advantageously enables the LED light fixture to receive a dimming input associated with any dimming protocol and control one or more lights using the received dimming input signal and/or a control signal generated from the dimming input signal. The automatic detection and control of one or more lights utilizing any dimming protocol advantageously decreases the installation cost of a light array and increases the effective uses of the light fixtures (e.g., a light fixture can be controlled by either a DMX512 protocol dimmer or a RDM protocol dimmer, only one type of light fixture can be manufactured and shipped to a building with multiple dimming protocols for installation, etc.).

For example, in operation, a dimmer and/or another type of control device (e.g., central control device, remote control device) can transmit the dimming input signal to the controller. The controller can accept any type of dimming input signal and can either discard the dimming input signal (e.g., the dimming input does not match any known dimming protocol and is considered noise, the dimming input exceeds acceptable voltage and/or current thresholds, etc.) and/or process the dimming input signal based on a detecting dimming protocol (e.g., convert the dimming input into instructions for a light, instruct a light to turn on/off, etc.).

As another example, in operation, the technology can receive a dimming input signal from a DMX512 protocol device, detect that the dimming input signal is in DMX512 protocol, and control a LED light based on the dimming input signal using the DMX512 protocol. As another example, in operation, the technology can receiving another dimming input signal from a RDM protocol device, detect the next dimming input signal is in RDM protocol, and control the LED light based on the dimming input signal using the RDM protocol. In other words, the same LED light fixture with the controller of the present technology and light of the present technology can operate using both the DMX512 protocol and the RDM protocol without having to be re-configured. The detection and control of LED lights utilizing any number and/or type of dimming protocols advantageously decreases the maintenance costs for light systems and increases the effective uses of the light systems by enabling any type and/or configuration of control of the light fixture.

Figure 1:
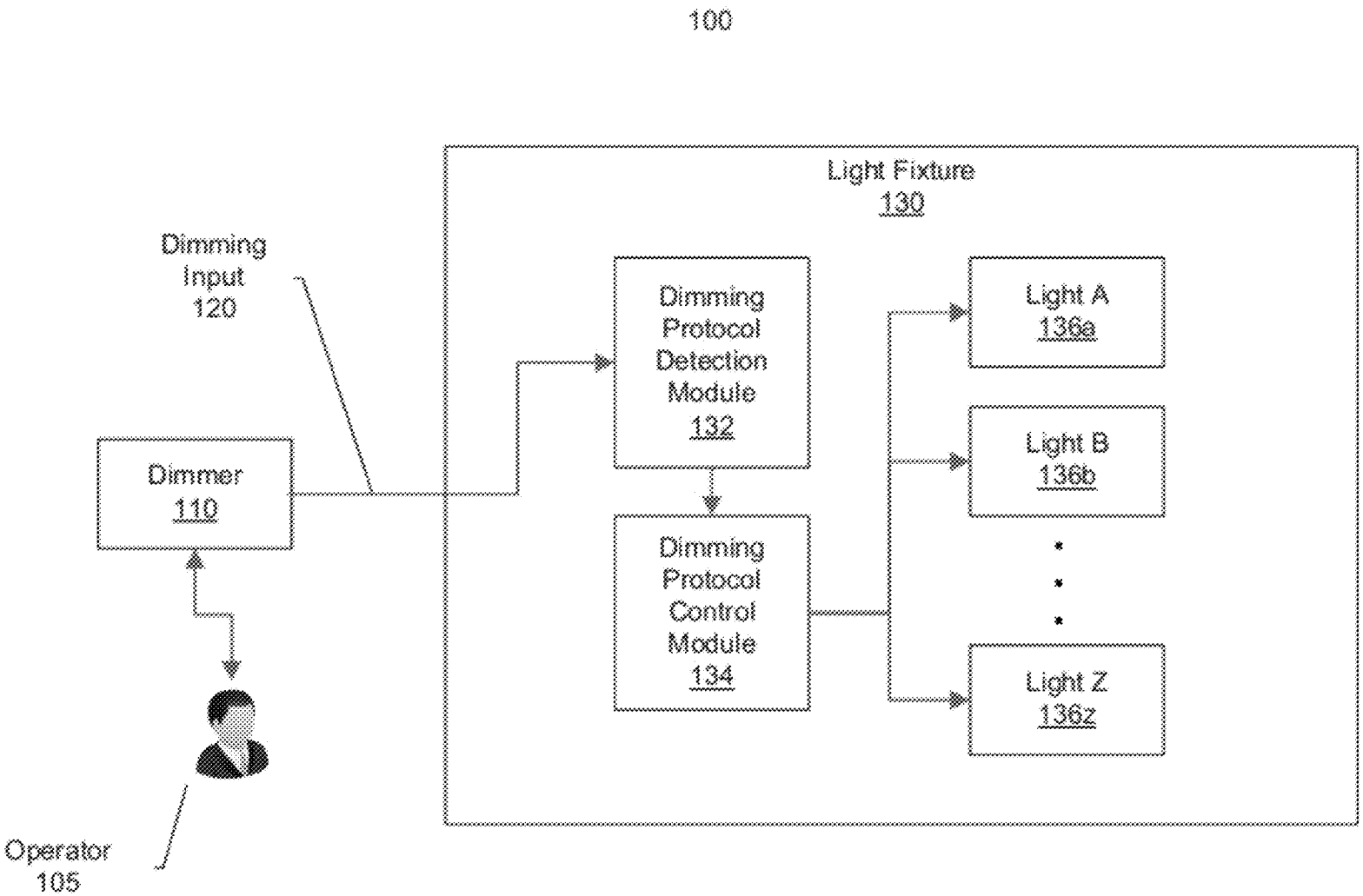
FIG. 1 is a block diagram of an exemplary lighting environment.

FIG. 1 is a block diagram of an exemplary lighting environment 100. The environment 100 includes a dimmer 110 and a LED light fixture 130. The LED light fixture 130 includes a dimming protocol detection module 132, a dimming protocol control module 134, and a plurality of LED lights A 136*a*, B 136*b* through 136*z*. An operator 105 adjusts the dimmer 110 (e.g., moves a knob, moves a slide, adjusts a digital setting, etc.). The dimmer 110 transmits a dimming input 120 (also referred to as a dimming input signal) to the LED light fixture 130 based on the adjustment from the operator 105. The dimming input 120 is transmitted in a dimming protocol (e.g., a 0-10 volt lighting control, digital addressable lighting interface (DALI), etc.).

The dimming protocol detection module 132 in the LED light fixture 130 detects a dimming protocol within the dimming input 120. In some examples, the dimming protocol detection module 132 detects the dimming protocol based on one or more parameters associated with a plurality of dimming protocols. In other examples, the dimming protocol detection module 132 detects the dimming protocol and/or changes in the dimming protocol in or near real-time with the receipt of the dimming input. The detection of the dimming protocol advantageously increases the available uses of the LED light fixture 130 by enabling the LED light fixture 130 to operate with any type and/or mode of dimmer 110. The dimming protocol detection module 132 can have protocol knowledge (e.g., format, type, content, etc.) of the plurality of dimming protocols.

Table 1 illustrates exemplary parameters associated with the plurality of dimming protocols. The dimming protocol detection module 132 can utilize the parameters illustrated in Table 1 to detect the dimming protocol within the dimming input 120. Table 2 illustrates exemplary dimming input and the detected dimming protocol based on parameters associated with the dimming protocols. As described in Table 2, the dimming protocol detection module 132 detects the dimming protocol of the dimming input 120 based on one or more parameters. Although Tables 1 and 2 illustrates detection of a dimming protocol based on one parameter, the dimming protocol detection module 132 can utilize any number of parameters to detect a dimming protocol (e.g., three parameters match, four parameters match and one parameter does not match, etc.).

TABLE 1

| Exemplary Parameters | |
|---|---|
| Parameters | Associated Dimming Protocol |
| Voltage between 0-10 volts | 0-10 volt lighting control |
| 0-63 bit addresses | DALI |
| RDM packet within DMX512 signal | RDM |
| Termination of Data Link of a value at least at 245 milli-volts | RDM |
| Termination of Data Link with Resistor no greater than 120 Ω | DMX512 |
| Communication Line is Isolated | DALI |
| ±5 volts | DMX |
| Data Speed = 250 kilobytes per second | DMX or RDM |
| Packet Structure Analysis for DMX Structure | DMX |
| Packet Structure Analysis for RDM Structure | RDM |

TABLE 2

| Exemplary Dimming Input | |
|---|---|
| Dimming Input | Dimming Protocol |
| Static Voltage of 4.5 volts | 0-10 volt lighting control |
| 23 bit address | DALI |
| Termination of Data Link at 230 milli-volts | RDM |
| Termination of Data Link at 100 Ω | DMX512 |
| Rapidly Changing Voltage | Not 0-10 volt lighting control |

The dimming protocol control module 134 controls the plurality of LED lights A 136*a*, B 136*b* through Z 136*z* based on the dimming input utilizing the detected dimming protocol. For example, the dimming protocol control module 134 processes the dimming input 120 (in this example, a 0-10 volt lighting protocol control signal to turn off light A 136*a*) based on the detected 0-10 volt protocol lighting control (in this example, 0-10 volt protocol lighting control). In this example, the dimming protocol control module 134 instructs LED lights A 136*a*, B 136*b* through Z 135*z* to turn off based on the dimming input 120. In some examples, the dimming input 120 can include addresses for a subset of the lights for control of the particular addressed lights. The automated detection of the dimming protocol and control of LED lights based on the detected dimming protocol advantageously decreases installation cost of light systems by reducing configuration time (e.g., setting of the type of dimming protocol, re-configuring the LED light fixture based on incorrect installation). The automated detection of the dimming protocol advantageously decreases installation cost by reducing re-installation of mis-configured lights (i.e., the mis-configured lights are damaged by an incorrect dimming input).

Although FIG. 1 illustrates the dimming protocol detection module 132 and the dimming protocol control module 134 in the LED light fixture 130, the dimming protocol detection module 132 and/or the dimming protocol control module 134 can be outside of the light fixture (e.g., centralized controller, add-on controller, etc.). Although FIG. 1 illustrates the dimming protocol detection module 132 and the dimming protocol control module 134 as separate modules, the functionality of the dimming protocol detection module 132 and the dimming protocol control module 134 can be within a single controller. Although FIG. 1 illustrates the dimmer 110 transmitting the dimming input 120 to the light fixture 130, any type of control device (e.g., centralized control device, remote control device, etc.) can be utilized to control the LED light fixture 130.

Figure 2:
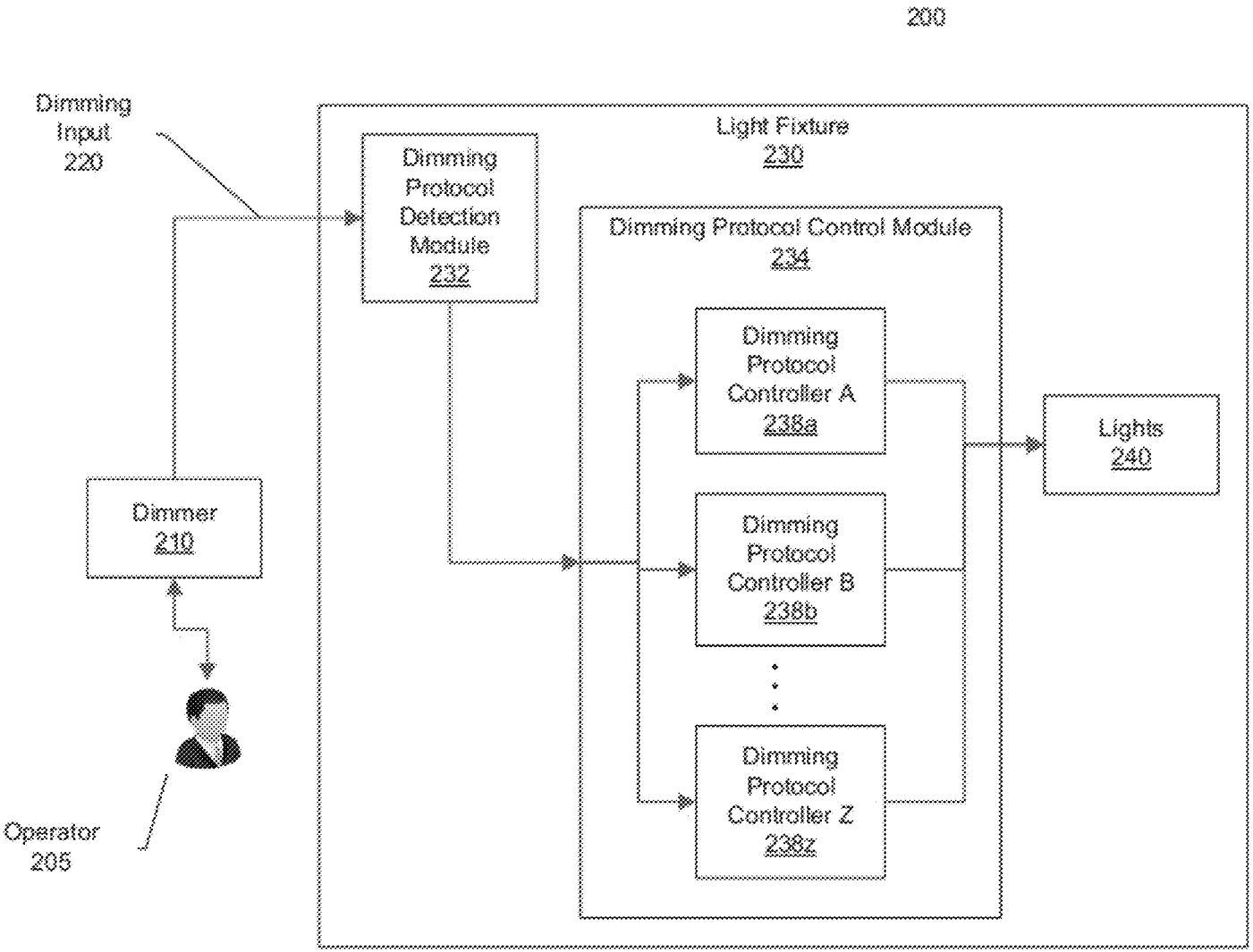
FIG. 2 is a block diagram of another exemplary lighting environment.

FIG. 2 is a block diagram of another exemplary lighting environment 200. The environment 200 includes a dimmer 210 and a LED light fixture 230. The LED light fixture 230 includes a dimming protocol detection module 232, a dimming protocol control module 234, and a plurality of lights 240. The dimming protocol control module 234 includes a plurality of dimming protocol controllers A 238*a*, B 238*b* through Z 238*z*. Each of the dimming protocol controllers A 238*a*, B 238*b* through Z 238*z* is associated with a dimming protocol and converts the dimming input 220 from the associated dimming protocol to a control signal for one or more of the plurality of the LED lights 240. For example, the dimming protocol controller A 238*a* is associated with the DMX512 protocol and converts the dimming input 220 from the DMX512 protocol to a control signal for the LED lights 240. As another example, the dimming protocol controller B 238*b* is associated with the RDM protocol and converts the dimming input 220 from the RDM protocol to a control signal for the LED lights 240.

An operator 205 adjusts the dimmer 210 (e.g., moves a knob, moves a slide, adjusts a digital setting, etc.). The dimmer 210 transmits a dimming input 220 to the LED light fixture 230 based on the adjustment from the operator 205. The dimming input 220 is transmitted in a dimming protocol (e.g., a 0-10 volt lighting control, digital addressable lighting interface (DALI), etc.). The dimming protocol detection module 232 in the LED light fixture 230 detects a dimming protocol within the dimming input 220. The dimming protocol control module 234 routes the dimming input 220 to the dimming protocol controller based on the detected dimming protocol. For examples, the dimming protocol controller A 238*a* is associated with the DMX512 protocol, and the detected dimming protocol is the DMX512 protocol. In this example, the dimming protocol control module 234 routes the dimming input 220 to the dimming protocol controller A 238*a*.

The respective dimming protocol controller A 238*a*, B 238*b* through Z 238*z* converts the dimming input 220 into one or more control signals for the LED lights 240 or a subset of the lights 240. For example, the dimming protocol controller converts the dimming input 220 into color temperature adjustments for the LED lights 240. As another example, the dimming protocol controller converts the dimming input 220 into an off control command for the LED lights 240.

Figure 3:
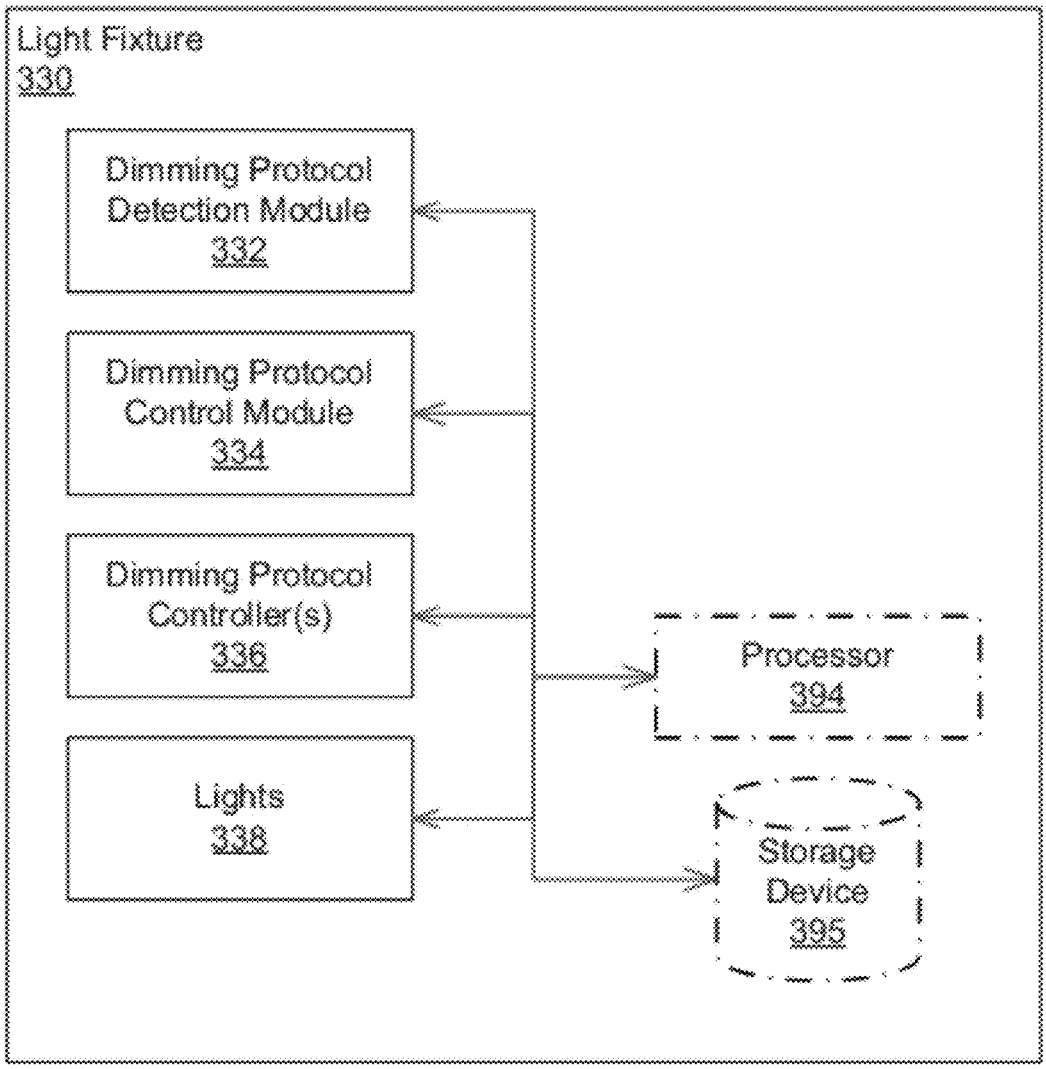
FIG. 3. is a block diagram of an exemplary light fixture.

FIG. 3 is a block diagram of an exemplary LED light fixture 330. The LED light fixture 330 includes a dimming protocol detection module 332, a dimming protocol control module 334, one or more dimming protocol controllers 336, which can be included within the dimming protocol module 334 or separate, as illustrated in FIG. 3, one or more lights 338, a processor 394, and a storage device 395. The processor 394 and the storage device 395 are optional components of the light fixture 330. The modules and devices described herein can, for example, utilize the processor 394 to execute computer executable instructions and/or the modules and devices described herein can, for example, include their own processor to execute computer executable instructions (e.g., a protocol processing unit, a field programmable gate array processing unit). It should be understood the LED light fixture 330 can include, for example, other modules, devices, and/or processors known in the art and/or varieties of the illustrated modules, devices, and/or processors.

The dimming protocol detection module 332 detects the dimming protocol received in the dimming input signal. The dimming protocol is detected from a plurality of dimming protocols (e.g., five different dimming protocols, one hundred different diming protocols, etc.). In some examples, the dimming protocol detection module 332 selects the dimming protocol from a plurality of dimming protocols based on one or more parameters associated with the plurality of dimming protocols. In other examples, the dimming protocol detection module 332 detects a second dimming protocol received in the dimming input signal.

The light dimming control module 334 controls the plurality of LED lights based on the detected dimming protocol. In some examples, the light dimming control module 334 controls the plurality of LED lights based on the detected second dimming protocol. In other examples, the light dimming control module 334 discontinue control of the plurality of LED lights based on the detected dimming protocol in real-time with the detection of the second dimming protocol.

Each dimming protocol controller 336 is associated with a dimming protocol from the plurality of dimming protocols. Each dimming protocol controller 336 converts the dimming input signal from the associated dimming protocol to a control signal for the plurality of LED lights 338

In some examples, the plurality of dimming protocols includes a 0-10 volt lighting control, digital addressable lighting interface (DALI), digital multiplex (DMX512) lighting interface, a remote device management (RDM) interface, and/or any other type of protocol usable to transmit control information to a light fixture (e.g., transmission control protocol (TCP), serial line communication, etc.). In other examples, the one or more parameters associated with the plurality of dimming protocols include a physical layer parameter, a network layer parameter, and/or any other type of electrical or network related parameters.

In some examples, the physical layer parameter includes a voltage parameter (e.g., below 5 volts, between 110-120 volts, etc.), a current parameter (e.g., above 3 amps, between 3-4 milliamps, etc.), an isolation parameter (e.g., noise threshold below a threshold, four other light fixtures detected on a power line, termination resistor, etc.), and/or any other type of physical layer parameter (e.g., number of units on a line, size and/or configuration of communication line, etc.). In other examples, the network layer parameter includes a communication protocol parameter (e.g., data packet parameter, broadcast packet, etc.), a command format parameter (e.g., data packet format, hello packet format, etc.), and/or any other type of network layer parameter (e.g., data content, network content, etc.)

In other examples, the light fixture 330 includes a dimming input module (not shown). The dimming input module detects the dimming input signal and controls the plurality of LED lights 338 based on the detection of the dimming input signal and the detected dimming protocol.

The processor 394 executes the operating system and/or any other computer executable instructions for the LED light fixture 330 (e.g., executes applications). The storage device 395 stores dimming protocol information and/or configuration information (e.g., light fixture serial number, light fixture address, light fixture usage, etc.). The storage device 395 can include a plurality of storage devices and/or the light fixture 330 can include a plurality of storage devices (e.g., a protocol storage device, an instruction storage device). The storage device 395 can include, for example, long-term storage (e.g., a hard drive, a tape storage device, flash memory), short-term storage (e.g., a random access memory, a graphics memory), and/or any other type of computer readable storage.

Figure 4:
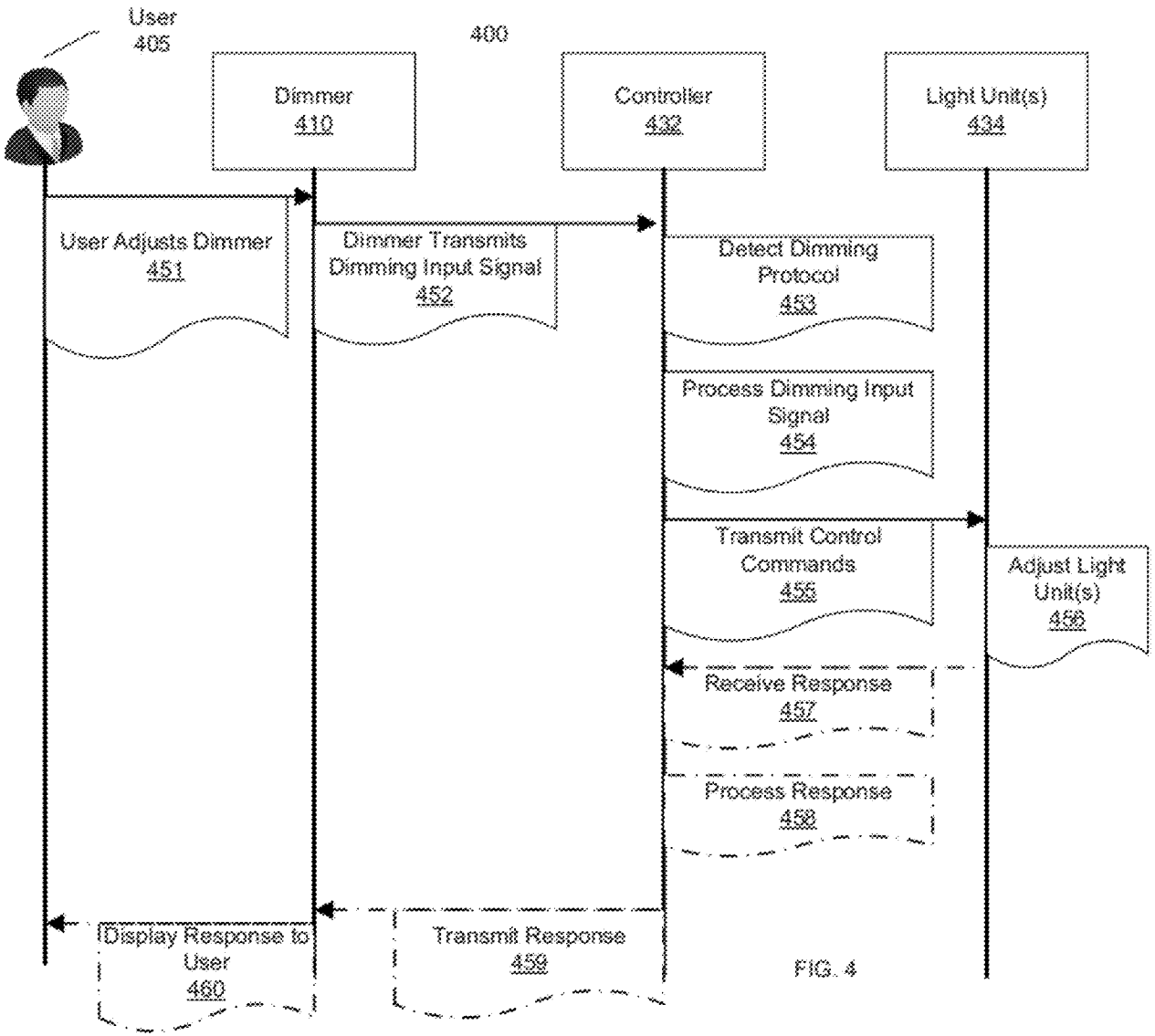
FIG. 4 is a process diagram of an exemplary dimming protocol detection method.

FIG. 4 is a process diagram of an exemplary dimming protocol detection method 400. A user 405 adjusts (451) a dimmer 410. The dimmer 410 transmits (452) a dimming input signal to a controller 432. The controller 431 and one or more LED light unit(s) 434 are part of a LED light fixture (e.g., the LED light fixture 230 of FIG. 2). In some examples, the controller 431 includes any of the modules and/or components described herein (e.g., dimming protocol detection module, dimming protocol control module, etc.). The controller 431 detects (453) a dimming protocol in the dimming input signal. For example, the controller 431 detects (453) a static address of 34 in the dimming input signal and associates the voltage detection with the DALI protocol.

The controller 431 processes (454) the dimming input signal based on the detected dimming input signal to generate one or more control commands for the one or more LED light unit(s) 434. For example, the controller 431 detects (453) a static address of 34 in the dimming input signal and associates the static address detection with the DALI protocol. In this example, the controller 431 processes (454) the dimming input signal in the DALI protocol to generate a control command for the one or more LED light unit(s) 434 (e.g., control command to turn off a light unit, control command to change the color temperature of a set of light units, etc.). The controller 432 transmits (455) the one or more control commands to the one or more LED light unit(s) 434. The one or more LED light unit(s) 434 adjust (456) based on the one or more control commands.

In some examples, as one or more optional parts, the process 400 includes the following steps. The one or more light unit(s) 434 transmits a response (e.g., control command completed, current color temperature output of a LED light unit, etc.) to the one or more control commands and/or any other type of information associated with the one or more LED light unit(s) 434. The controller 432 receives (457) the response and processes (458) the response (e.g., generates output for display by a dimmer 410 to the user 405, re-formats the response into the detected dimming protocol, etc.). The controller 432 transmits (459) the response to the dimmer 410 and the dimmer 410 displays (460) the response to the user 405.

Figure 5:
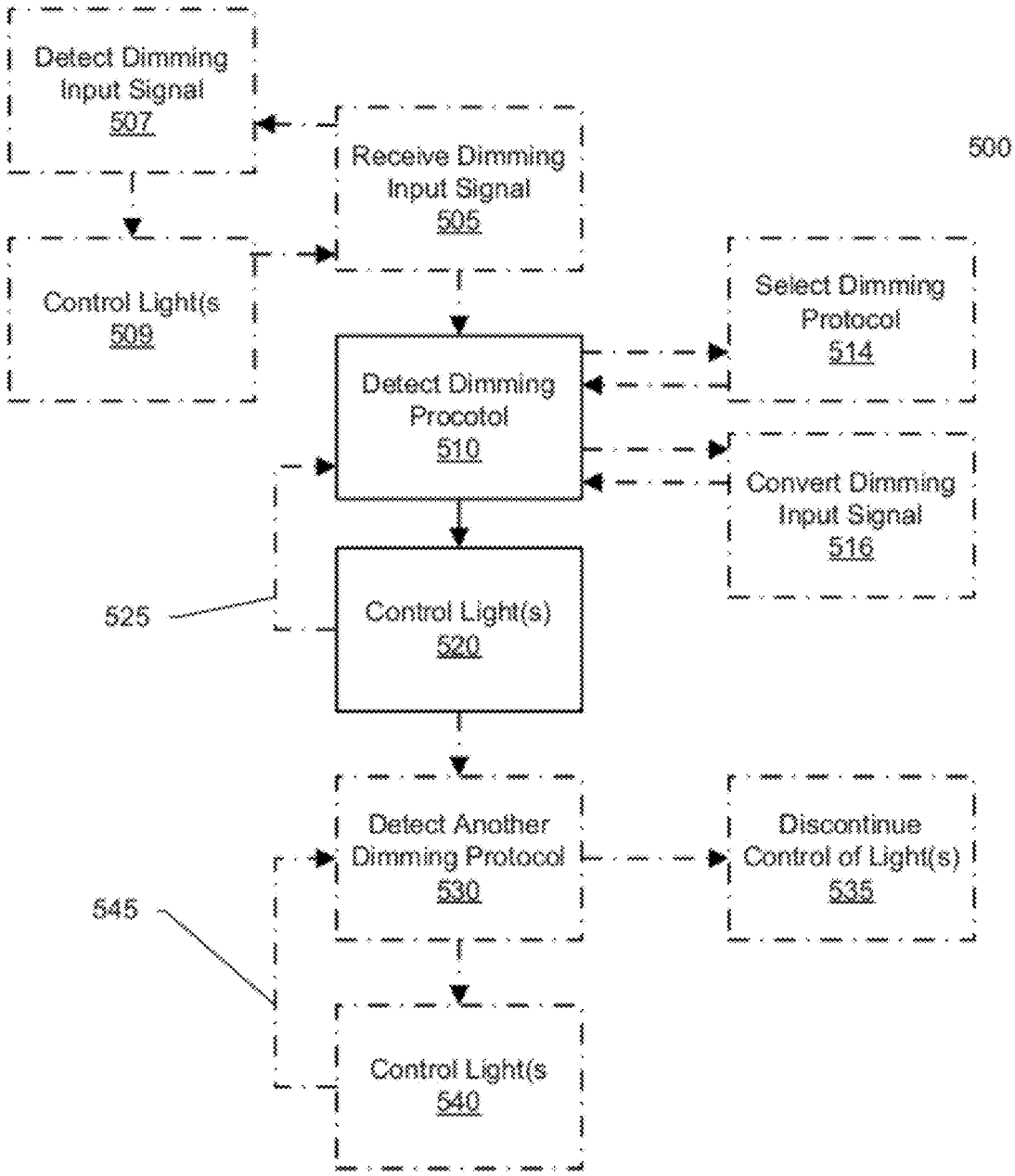
FIG. 5 is a flowchart of another exemplary dimming protocol detection method.

FIG. 5 is a flowchart of another exemplary dimming protocol detection method 500 utilizing, for example, the LED light fixture 330 of FIG. 3. The dimming protocol detection module 332 detects a dimming protocol received in a dimming input signal. The dimming protocol control module 334 controls a plurality of LED lights based on the detected dimming protocol.

In some examples, the dimming protocol detection module 332 selects (514) the dimming protocol from a plurality of dimming protocols based on one or more parameters associated with the plurality of dimming protocols. The plurality of dimming protocols includes a 0-10 volt lighting control, digital addressable lighting interface (DALI), digital multiplex (DMX512) lighting interface, a remote device management (RDM) interface, or any combination thereof. The one or more parameters associated with the plurality of dimming protocols include a physical layer parameter, a network layer parameter, or any combination thereof.

In other examples, the dimming protocol detection module 332 receives (505) the dimming input signal from a dimmer (e.g., rheostat dimmer, thyristor dimmer, etc.). In some examples, the dimming protocol detection module 332 detects (530) another dimming protocol received in the dimming input signal. In other examples, the dimming protocol control module 334 controls (540) the plurality of LED lights based on the detected second dimming protocol.

In some examples, the dimming protocol control module 334 discontinues (535) control of the plurality of LED lights based on the detected dimming protocol in real-time with the detection of the second dimming protocol. In other examples, the dimming protocol control module 334 converts (516) the dimming input signal from the associated dimming protocol to a control signal for the plurality of LED lights.

In some examples, the dimming protocol detection module 332 detects (507) the dimming input signal. In other examples, the dimming protocol detection module 334 controls (509) the plurality of LED lights based on the detection of the dimming input signal and the detected dimming protocol. For example, the dimming protocol detection module 334 controls (509) the plurality of LED lights based on no input in the dimming input signal and that the detected dimming protocol requires a specified control based on no input (e.g., the DALI protocol requires the lights be at full output, 0-10 volt requires the lights be at full output, the DMX protocol requires the lights be at the last known value, etc.). The detection of the dimming input signal and control based on the same advantageously enables the technology to abide by dimming protocol standards, thereby increasing the efficiency of the LED light fixtures and reducing installation costs.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A system, comprising:

a dimmer configured to transmit a dimming input signal, the dimming input signal being in a dimming protocol; and a light fixture comprising:

a plurality of lights, a dimming protocol detection module that automatically detects in real time at least one parameter of the dimming protocol received in the dimming input signal, the dimming protocol being detected from a plurality of dimming protocols, and a light dimming control module that automatically reconfigures to match the detected dimming protocol based on the at least one parameter to control the plurality of lights based on the detected dimming protocol, wherein the at least one parameter for a digital multiplex (DMX) dimming protocol is at least one of a termination of a data link with a resistor having a value of no greater than 120 ohms, a voltage ranging from −5 volts to +5 volts, a data speed=250 kilobytes per second, a packet structure analysis for a DMX structure or combination thereof, wherein the at least one parameter for a remote device management (RDM) dimming protocol is at least one of a RDM packet within a DMX512 signal, a termination of a data link having a value of at least 245 millivolts, a data speed=250 kilobytes per second, a packet structure analysis for a RDM structure or combination thereof, wherein the at least one parameter for a digital addressable lighting interface (DALI) dimming protocol is at least one of a 0-63 bit address, an isolated communication line or combination thereof, and wherein the at least one parameter for a 0-10 v lighting control dimming protocol is at least a voltage ranging from 0-10 v.

2. A light fixture, comprising:

a plurality of lights;

a dimming protocol detection module that automatically detects in real time at least one parameter of a dimming protocol received in a dimming input signal; and a light dimming control module that automatically reconfigures to match the detected dimming protocol based on the at least one parameter to control the plurality of lights based on the detected dimming protocol;

wherein the at least one parameter for a digital multiplex (DMX) dimming protocol is at least one of a termination of a data link with a resistor having a value of no greater than 120 ohms, a voltage ranging from −5 volts to +5 volts, a data speed=250 kilobytes per second, a packet structure analysis for a DMX structure or combination thereof;

wherein the at least one parameter for a remote device management (RDM) dimming protocol is at least one of a RDM packet within a DMX512 signal, a termination of a data link having a value of at least 245 millivolts, a data speed=250 kilobytes per second, a packet structure analysis for a RDM structure or combination thereof;

wherein the at least one parameter for a digital addressable lighting interface (DALI) dimming protocol is at least one of a 0-63 bit address, an isolated communication line or combination thereof; and wherein the at least one parameter for a 0-10 v lighting control dimming protocol is at least a voltage ranging from 0-10 v.

3. The light fixture of claim 2, further comprising the dimming protocol detection module further configured to select the dimming protocol from a plurality of dimming protocols based on one or more parameters associated with the plurality of dimming protocols.

4. The light fixture of claim 3, wherein the plurality of dimming protocols comprises a 0-10 volt lighting control, digital addressable lighting interface (DALI), digital multiplex (DMX512) lighting interface, a remote device management (RDM) interface, or any combination thereof.

5. The light fixture of claim 3, wherein the one or more parameters associated with the plurality of dimming protocols comprise a physical layer parameter, a network layer parameter, or any combination thereof.

6. The light fixture of claim 5, wherein the physical layer parameter comprises a voltage parameter, a current parameter, an isolation parameter, or any combination thereof.

7. The light fixture of claim 5, wherein the network layer parameter comprises a communication protocol parameter, a command format parameter, or any combination thereof.

8. The light fixture of claim 2, wherein the dimming input signal is received from a dimmer.

9. The light fixture of claim 2, further comprising:

the dimming protocol detection module automatically detects in real time at least one parameter of a second dimming protocol received in the dimming input signal; and the light dimming control module further configured to automatically reconfigure to match the detected second dimming protocol based on the at least one parameter to control the plurality of lights based on the detected second dimming protocol.

10. The light fixture of claim 9, wherein the light dimming control module further configured to automatically discontinue control of the plurality of lights based on the detected dimming protocol in real-time with the detection of the second dimming protocol.

11. The light fixture of claim 2, wherein the light dimming control module comprising a plurality of dimming protocol controllers, each dimming protocol controller of the plurality of dimming protocol controllers being associated with a dimming protocol from the plurality of dimming protocols and configured to convert the dimming input signal from the associated dimming protocol to a control signal for the plurality of lights.

12. The light fixture of claim 2, further comprising a dimming input module configured to:

detect the dimming input signal; and control the plurality of lights based on the detection of the dimming input signal and the detected dimming protocol.

13. A dimming protocol detection method, comprising:

automatically detecting in real time at least on parameter of a dimming protocol received in a dimming input signal; and automatically configuring to match the detected dimming protocol based on the at least one parameter and controlling a plurality of lights based on the detected dimming protocol;

wherein the at least one parameter for a digital multiplex (DMX) dimming protocol is at least one of a termination of a data link with a resistor having a value of no greater than 120 ohms, a voltage ranging from −5 volts to +5 volts, a data speed=250 kilobytes per second, a packet structure analysis for a DMX structure or combination thereof;

wherein the at least one parameter for a remote device management (RDM) dimming protocol is at least one of a RDM packet within a DMX512 signal, a termination of a data link having a value of at least 245 millivolts, a data speed=250 kilobytes per second, a packet structure analysis for a RDM structure or combination thereof;

wherein the at least one parameter for a digital addressable lighting interface (DALI) dimming protocol is at least one of a 0-63 bit address, an isolated communication line or combination thereof; and wherein the at least one parameter for a 0-10 v lighting control dimming protocol is at least a voltage ranging from 0-10 v.

14. The method of claim 13, further comprising selecting the dimming protocol from a plurality of dimming protocols based on one or more parameters associated with the plurality of dimming protocols.

15. The method of claim 14, wherein the plurality of dimming protocols comprises a 0-10 volt lighting control, digital addressable lighting interface (DALI), digital multiplex (DMX512) lighting interface, a remote device management (RDM) interface, or any combination thereof.

16. The method of claim 14, wherein the one or more parameters associated with the plurality of dimming protocols comprise a physical layer parameter, a network layer parameter, or any combination thereof.

17. The method of claim 13, further comprising receiving the dimming input signal from a dimmer.

18. The method of claim 13, further comprising:

automatically, in real time, detecting at least one parameter of a second dimming protocol received in the dimming input signal; and automatically reconfiguring to match the detected second dimming protocol based on the at least one parameter and controlling the plurality of lights based on the detected second dimming protocol.

19. The method of claim 18, further comprising automatically discontinuing control of the plurality of lights based on the detected dimming protocol in real-time with the detection of the second dimming protocol.

20. The method of claim 13, further comprising converting the dimming input signal from an associated dimming protocol to a control signal for the plurality of lights.

21. The method of claim 13, further comprising:

detecting the dimming input signal; and controlling the plurality of lights based on the detection of the dimming input signal and the detected dimming protocol.

* * * * *